United States Patent [19]

Tubman

[11] Patent Number: 4,720,911

[45] Date of Patent: Jan. 26, 1988

[54] CONTACT PRESS TOOL AND ELECTRIC CONNECTOR

[76] Inventor: Iosif Tubman, 1480 E. 17th St., Brooklyn, N.Y. 11230

[21] Appl. No.: 852,760

[22] Filed: Apr. 16, 1986

[51] Int. Cl.[4] ..... H01R 43/04; H01R 4/24

[52] U.S. Cl. ..... 29/752; 29/566.4; 439/877; 174/84 C

[58] Field of Search ..... 339/276 R, 276 S, 276 T, 339/223 R; 174/84 C; 72/391; 29/33 M, 566.4, 749, 750, 751, 756; 439/877

[56] References Cited

U.S. PATENT DOCUMENTS 2,324,104 7/1943 Moss ..... 72/391

3,605,077 9/1971 Kaylor ..... 339/276 T

*Primary Examiner*—Z. R. Bilinsky

*Attorney, Agent, or Firm*—Richard L. Miller

[57] ABSTRACT

A contact press tool and electric connector is provided and consists of a modified pip-rivet gun and modified butt connector. The connector has a hole in the center through which a rod on a press member is inserted. The rod is subsequently passed through an anvil mounted on the gun and then into the cylinder of the pop-rivet gun. When the pop-rivet gun is activated the connector is compressed between the anvil and press member affecting the securing of wires in the connector.

4 Claims, 5 Drawing Figures

58
70
62
12
56
60
60
64
64
68

14
60
58
72
62
70
12
56
60
14
66
68
72
66

20
18
24
30
22
10
36
32
28
26
34
66
14
40
38
72
42
62
2
60
56
12
60
64
14
2
66
72
46
54
16
52
54
46
44
52
16
44

74
80
62
76
14
66

CONTACT PRESS TOOL AND ELECTRIC CONNECTOR

BACKGROUND OF THE INVENTION

This invention relates to electric connectors; and more particularly to a contact press tool and electric connector.

Splicing and securing electric wires together is an on going requirement in all types of electrical installations. The simplest form of splicing is accomplished by twisting the terminal ends of wires together and overwrapping the twisted pair with tape. Wire nuts are used in a similar manner by "screwing" the wire nut onto the twisted wires. These methods are not always positive and lack aesthetic.

Securing wires to terminals is accomplished in a number of different ways e.g; placing the wire under a screw head, placing the wire into a spring clip and by attaching a connector to the trimmed wire which is in turn secured under a screw head. These methods may result in connections which loose their integrity.

Various crimping tools and connectors are in use. An open U-type of connector for connecting two wires is shown in U.S. Pat. No. 3,328,872 others are shown in U.S. Pat. Nos. 3,393,438 and 3,962,901.

None of these use a butt connector crimped on both ends simultaneously.

SUMMARY OF THE INVENTION

It is therefore an object of this invention to provide a new and improved connector.

It is another object of this invention to provide a new and improved connector with a hole.

It is still another object of this invention to provide a new and improved contact press tool.

It is yet another object of this invention to provide a new and improved contact press tool with a rod.

It is a further object of this invention to provide a new and improved contact press tool with a wire stripper.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DESCRIPTION OF THE PREFERRED EMBODIMENT

Figures 1, 2, 3, 4, 5:
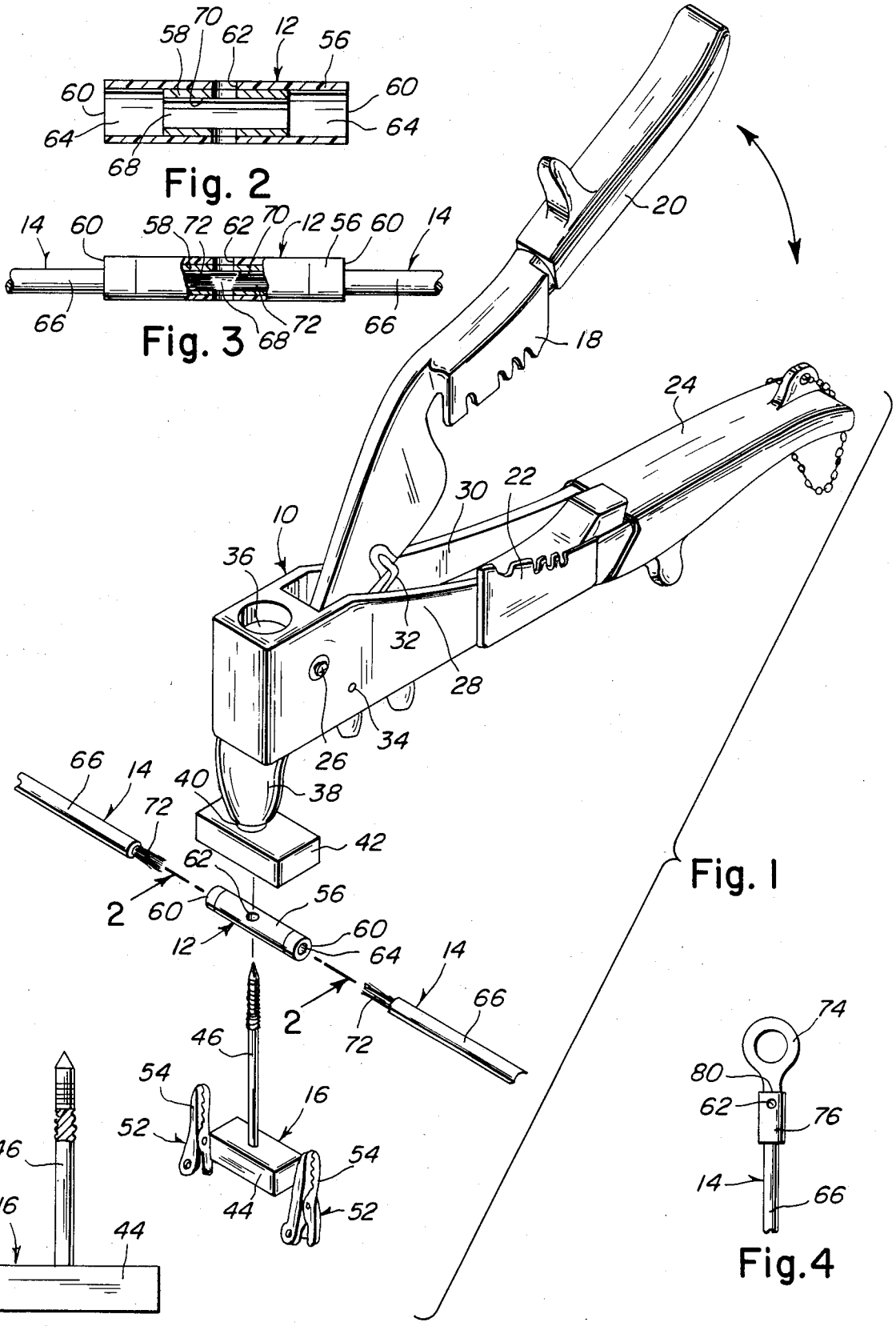
FIG. 1 is an exploded perspective view of the invention in use.
FIG. 2 is an enlarged cross sectional view taken along line 2—2 in FIG. 1 through the connector before crimping.
FIG. 3 is an enlarged elevational view of the connector with parts broken away to show the wires crimped therein.
FIG. 4 is a plan view of a endless loop type connector already crimped on a wire with the tool.
FIG. 5 is a front elevational view of a press member taken in the direction of arrow 5 in FIG. 1 with the clips removed.

With reference to FIG. 1 there is shown a contact press tool 10 a connector 12 a pair of wires 14 and a press member 16. Press tool 10 is a modified pop-rivet tool having a first wire stripper member 18 attached to an upper arm 20 and a second wire stripper member 22 attached to a lower arm 24.

Arm 20 is pivotally mounted on a shaft 26 disposed between a first wall 28 and a second wall 30 of arm 24. A spring 32 in the form of a helical coil with a leg is mounted on a pin 34 and coacts with arm 20. A cylinder 36 is constructed for co-operation with arm 20 as in a conventional pop-rivet tool. A housing 38 which contains cylinder 36 therein has fixedly secured to its end 40 an anvil 42. Press member 16 (FIG. 5) consists of a block 44 in the form of a parallelepiped having a rod 46 centrally located on block 44. Anvil 42 has a hole (not shown) in its center of predeteremined size to allow passage of rod 46 through to a cavity (not shown) cylindrical form and centrally located in cylinder 36. A bracket 52 has disposed proximate each end an alligator clip 54. The anvils are of steel, hard aluminum or the like.

Connector 12 (FIG. 2) includes a housing 56 tubular in form and of electrically non conductive material such as plastic. An internal sleeve 58 of conductive material is of a predetermined size so as to press fit into housing 56. Sleeve 58 is disposed equidistant from a pair of ends 60 of housing 56. A hole 62 is disposed transversely through housing 56 and sleeve 58 is of a predetermined size to allow passage of rod 46. A pair of openings 64 of predetermined size to accommodate an insulated portion 66 of wire 14 is disposed at each end 60 of housing 56. An aperture 68 formed by an internal surface 70 of sleeve 58 is of a predetermined size to accommodate a stripped portion 72 of wire 14. In FIG. 3 stripped portion 72 is in intimate contact with internal surface 70 after compression. In FIG. 4 an endless loop connector 74 is affixed to a housing 76 and sleeve (not shown) constructed in a similar manner as housing 56 and sleeve 58 with hole 62 disposed proximate an end 80 of housing 76.

METHOD OF OPERATION

Wire 14 is stripped by placing wire 14 into one of the grooves in wire stripper member 22 designated for the wire gage being used, clamping wire stripper 18 and pulling wire 14 and preparing a stripped portion 72. Stripped portion 72 is inserted into each end of connector 12 and into aperture 68 of sleeve 58. Rod 46 is positioned through hole 62 of connector 12 through hole 48 of anvil 42 and into cavity (not shown). Alligator clips 54 are attached to wire 14 where press member 16 is snug to connector 12. Handle 20 is rotatively activated causing the compression of connector 12.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An electric connector comprising:

(a) an outer housing of non conductive material and having a uniform outer cylindrical periphery;

(b) a sleeve of conductive material carried within said housing said sleeve being of shorter length than said outer housing and centrally disposed therein, whereby said sleeve accommodates a stripped wire and the portions of the housing on either side of the sleeve accommodates the unstripped wire, the ends of the sleeve forming stops for the insulation; and (c) a hole of predetermined size transverse to a horizontal axis of said housing and said sleeve, centrally disposed along said axis concurrent with a diameter of said housing and passing entirely through said housing and said sleeve to accommodate a rod passing therethrough with compression members on either side of the rod to facilitate compression said housing and said sleeve to crimp the insulated and and unisulated parts of the wire inserted within the connector.

2. A gun-like contact press tool comprising: a first arm; a second arm pivotally mounted with respect to the first arm; spring means for spring connection of the two arms; a cylindrical member operated to extend between a retracted and an extended position by movement of said arms; a cylindrical cavity in said cylindrical member; means in said cavity for securing a rod inserted therein; an anvil with a central through hole connected to the cylindrical member, the through hole being aligned with the cavity, and a separate press member having a rod centrally disposed thereon and extending therefrom said rod receivable within the through hole and into the cavity for securement therein, whereby an electrical connector can be sandwiched between the anvil and the press member to be crimped upon operation of the arms with retracting the cylindrical member.

3. A gun-like contact press tool as in claim 2 and further comprising a cylindrical hollow electrical connector for receiving wires into opposing ends thereof for crimping of the wires, a transverse hole through said cylindrical housing to receive said rods whereby the cylindrical housing can be sandwiched between the anvil and the press member.

4. The contact press tool of claim 3, wherein a pair of alligator clips are affixed to said press member to hold the wires.

* * * * *